United States Patent [19]

Bodine

[11] 4,446,933

[45] May 8, 1984

[54] ROTARY EARTH BORING DRILL BIT WITH CENTRIFUGAL LUBRICATION SYSTEM

[76] Inventor: Albert G. Bodine, 7877 Woodley Ave., Van Nuys, Calif. 91406

[21] Appl. No.: 362,886

[22] Filed: Mar. 29, 1982

[51] Int. Cl.[3] ..... E21B 10/22

[52] U.S. Cl. ..... 175/229; 175/228; 384/93

[58] Field of Search ..... 175/227–229, 175/337, 340, 371, 372; 384/92, 93

[56] References Cited

U.S. PATENT DOCUMENTS

| | | | |
|---|---|---|---|
| 2,906,504 | 9/1959 | Parks | 175/228 |
| 3,244,459 | 4/1966 | Ortloff | 175/229 |
| 3,841,422 | 10/1974 | Crow | 175/229 |
| 4,167,219 | 9/1979 | McQueen | 175/372 X |
| 4,183,416 | 1/1980 | Walters | 175/228 X |
| 4,223,749 | 9/1980 | Bodine et al. | 175/337 X |

*Primary Examiner*—Ernest R. Purser
*Assistant Examiner*—Thuy M. Bui
*Attorney, Agent, or Firm*—Edward A. Sokolski

[57] ABSTRACT

A drilling bit for drilling earthen material such as an oilwell rotary cone drilling bit which includes means for centrifugally providing lubricant to the drill bit cone bearing from a storage cavity. A storage cavity is provided for lubricant for the drill bit bearings, means being provided for forcing the lubricant from this cavity through channels to such bearings in response to the centrifugal force generated with the rotation of the bit.

5 Claims, 4 Drawing Figures

ROTARY EARTH BORING DRILL BIT WITH CENTRIFUGAL LUBRICATION SYSTEM

This invention relates to rotary drill bits for drilling earthen material such as in the drilling of oilwells, and more particularly to such a device which employs centrifugal force to drive lubricant to the drill bit bearings from a storage cavity.

In U.S. Pat. Nos. 4,156,470 and 4,223,749, of which I am a co-inventor, a centrifugal slinger device is described that operates in conjunction with a channel structure to effect the lubrication of the cone shaft bearings of a roller cone bit; this device at the same time acting as a barrier to prevent particulate material from reaching these bearings. This device has been found to be quite effective in preventing foreign particles from entering the region of the bearings. However, some shortcomings have been experienced in providing sufficient good quality lubricant to the bearing area of the roller cones on a continual basis.

The device of the present invention overcomes the aforementioned shortcomings of the prior art by providing a storage cavity for the lubricating fluid and means for pumping such lubricating fluid from the cavity to the bearings in response to the centrifugal force generated during the rotation of the bit.

Briefly described, the present invention achieves these desired end results in the following manner. Oil or grease for lubricating the bearings is stored in a storage cavity formed in the drill bit structure from which channels are provided to the area of the bearings to be lubricated. A floating seated piston is installed adjacent to the lubricant storage cavity, this piston having one side thereof in direct communication with the storage cavity and the opposite side thereof in communication with a second cavity. The second cavity is connected by channel means to a region outwardly spaced on the rotary drill bit cone from the rotary bearings thereof and in fluid communication with such region. Fluid from said region outwardly of the bearings is centrifugally forced into the second cavity, the centrifugal pressure thus developed in such cavity (relative to that in the storage cavity) driving the floating piston such as to force lubricating fluid out of the storage cavity to the bearings. The bearings are thus continually provided with fresh lubricating fluid from the storage cavity in response to the centrifugal force.

It is therefore an object of this invention to improve the lubrication of the bearings of a rotary drill bit.

It is still another object of this invention to employ the centrifugal force generated with the rotation of a rotary drill bit to drive lubricating fluid from a storage cavity to the drill bit bearings.

Other objects of this invention will become apparent as the description proceeds in connection with the accompanying drawings of which:

Figure 1:
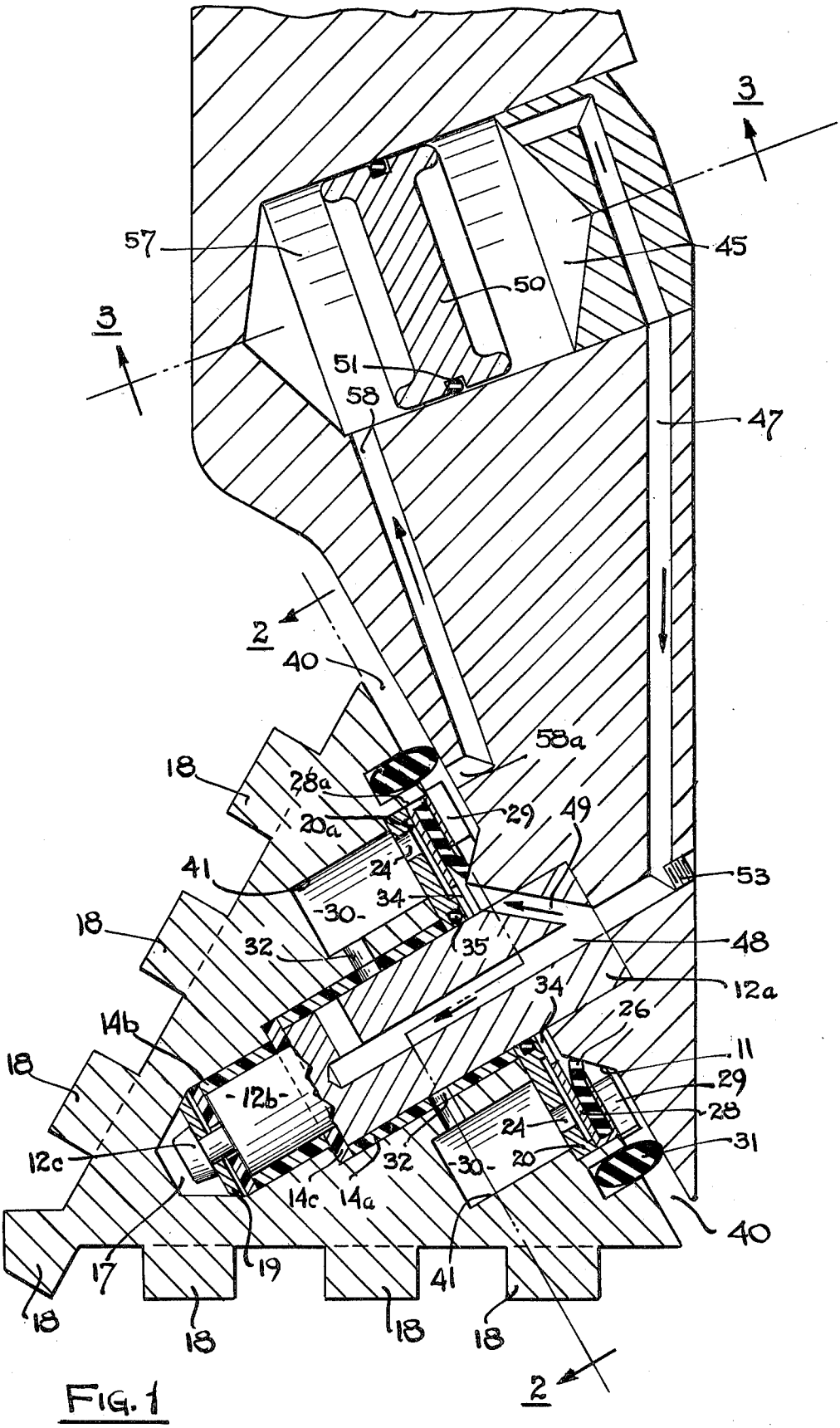
FIG. 1 is a cross-sectional view of a first embodiment of the invention.
Figure 2:
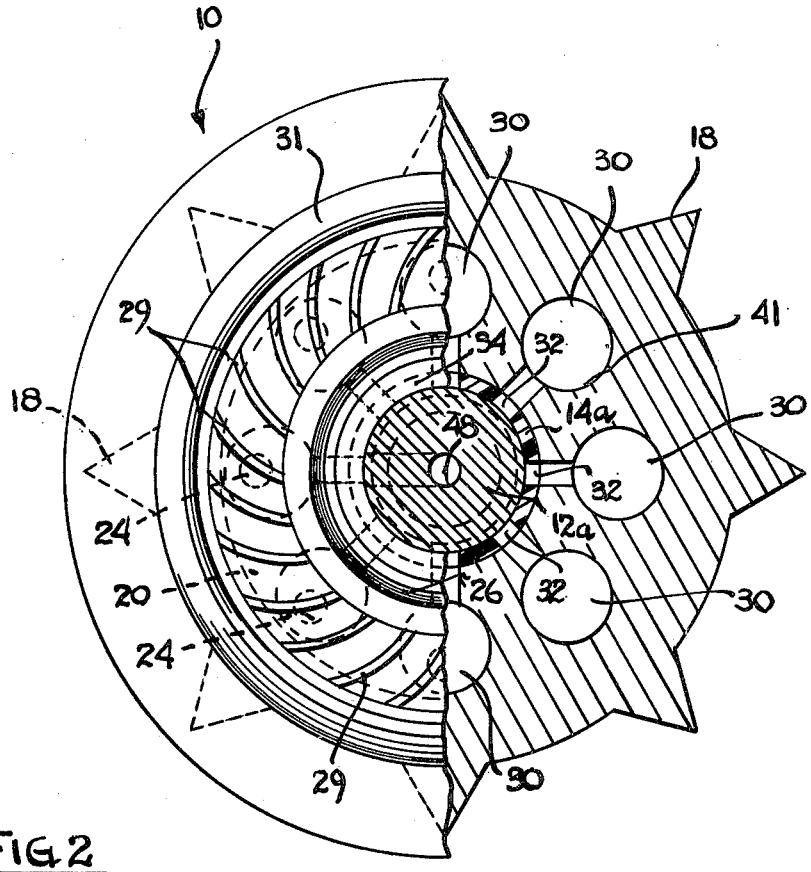
FIG. 2 is a cross-sectional view taken along the plane indicated by 2—2 in FIG. 1.
Figure 3:
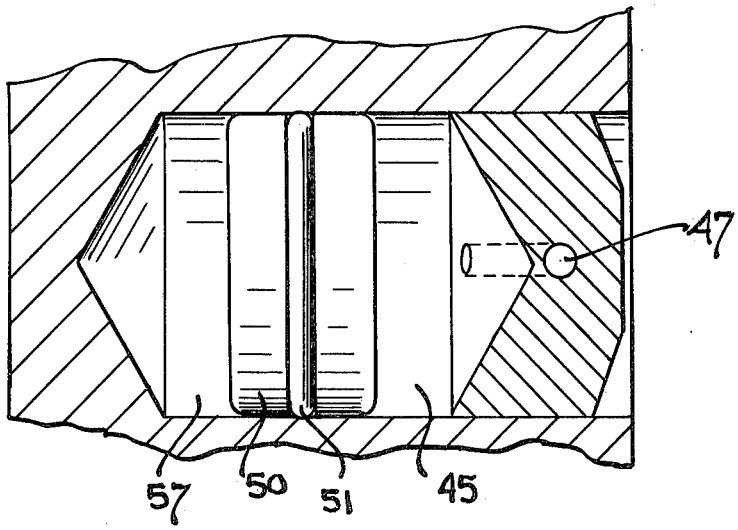
FIG. 3 is a cross-sectional view taken along the plane indicated by 3—3 in FIG. 1.

Referring now to FIGS. 1-3, a first embodiment of the invention is shown. Drill bit member 10 in the illustrative embodiment is of the roller cone type which is employed for drilling oil wells, and has a plurality of teeth 18 formed therearound. Such roller cone bits are manufactured by a number of manufacturers including Smith Tool, Irvine, Calif. and Reed Tool Company, Houston, Tex.

The bit 10 is rotatably mounted on a bearing pin which includes two cylindrical sections, 12*a* and 12*b*, the latter of these sections being stepped down in diameter to provide bearing support for the small end of the cone. The bit has a hollowed out central portion 17, which has stepped cylindrical sections to mate with bearing pin sections 12*a* and 12*b*. The inner walls of hollowed out portion 17 have sleeve bearings 14*a*, 14*b* and 14*c* fixedly attached thereto or formed thereon. These bearings may be made of a highly durable material such as nitralloy or high pressure bronze or fabric-phenolic, which will work with water as part or all of its lubricant. It is to be noted that the invention can be used to equal effect with bits employing conventional roller and ball bearings. The bearing pin also includes a cap 12*c* which operates to retain the bit on the pin, this cap abutting against disc-shaped inner wall portion of the bit.

Disc member 20 is fixedly attached to or a part of the bit cone and rotates therewith, this disc member being externally concentric with bearing pin portion 12*a*. Disc 20, as to be explained further on in the specification, operates as a slinger to drive particulate material centrifugally outwardly, away from the bearings. Disc 20 has a plurality of fluid passages or ports 24 located in the outer portion thereof.

A plurality of chambers 30 are spaced within cone 10 around pin portion 12*a*, these chambers being in fluid communication with apertures 24 formed in disc 20 and with channels 32 which extend to the surfaces of the pin portions 12*a* through the bearing material of sleeve bearing 14*a*. A flap ring seal 26 is supported on an inner wall of the bit cone by means of holder 28, the ends of this seal abutting against sloped shoulder 11. Holder 28 has an annular or disc-shaped wall portion 28*a* which extends parallel therefrom forming a holder around flap seal 26. A lubricant such as a suitable lubricating oil may be placed in chambers 30, this oil being retained within these chambers during shipping and when rotation of the bit is stopped during drilling operations by means of seal 26 and the annular wall portion 28*a* of the holder. These annular wall portions 28 and 28*a* are particularly needed to serve as an oil "trap" in the event that the flap ring seal should wear out. It is to be noted in this regard that in certain instances it is necessary to stop the rotation of the bit quite a number of times during the drilling operation. When the bit stops turning, the roller cones will each have a cavity 30 at a "high" point. With a relatively long pause, there is a possibility of the lighter density oil fraction within the bearing to migrate through channels 32 to the high points of the cavities and if it were not for the "trap" provided, out through apertures 24 and passageways 40 (but for seal 31). In addition, the wall portion 28*a* positioned opposite the face of slinger disc 20 provides more effective centrifugal action between these members to condition the fluid separation ahead of ports 24. The face portion 20*a* of disc 20 is grooved to provide a channel between this face portion and the opposing surface of wall portion 28*a*.

It is to be noted that during rotation of the drill the ends of flexible seal 26 are driven outwardly away from shoulder 11 by the centrifugal force. Light pressure O-ring seal 31 or any other similar light duty closure or baffle is installed in a channel formed in the body of the cone and seals passageway 40, particularly during storage and shipping. Ring-shaped insert member 28 carries curved blades or vanes 29. These vanes rotate with the bit cone near the periphery thereof and operate to drive large or heavier particles such as cuttings outwardly. An O-ring seal 35 may be provided along the inner edge of disc 20 but sealing it at this point is not absolutely necessary in view of the fact that the operation of slinger disc usually prevents particulate material from reaching this point.

The device operates as follows: With the bit cone rotating, a centrifugal force is generated in the space 34 and outward along the rotating cone where particulate material first meets the walls of rotating discs 20 and 28. The particulate material inside of disc 28 migrates radially outwardly to ports 24 and passes through these ports into chambers 30 and is held against the outer wall portions 41 of these chambers by the centrifugal force. The particulate material tends to force the lighter oil or clean water centrifugally separated therefrom through ports 32 to the bearing surfaces.

The lubricating and particle barrier system employed is in the nature of a rotating "U-tube", with passageway 34 forming one leg of the "U", and a portion of chambers 30 and channels 32 forming the other leg, with the two legs being interconnected by ports 24 and the outer portions of chambers 30. Chambers 30 form the central interconnecting portions of the "U-tubes" and function as solids traps at the effective perimeter of the centrifuge formed thereby, while ends 32 of the "U"'s provide outlets to the bearings for clean lubricant, and at the opposite ends, passageways 34 form inlets to chambers 30 for water which initially may be combined with particulate material.

The device as thus far described is essentially the same as the device of the aforementioned U.S. Pat. No. 4,223,749. The present invention is concerned with an improved lubricating system for the bearings which provides a constant supply of clean lubricant in response to the centrifugal force generated with the rotation of the bit.

Lubricant cavity 45 is formed in the body of of the bit, this cavity being in fluid communication with bit bearings **14*a*–14*c* through channels 47, 48 and 49 formed in the body of the bit. A floating piston member 50 is installed in the body of the bit and immediately adjacent to cavity 45, this piston forming a wall of the cavity. The piston is suitably sealed around its perifery by means of seal member or O-ring 51**.

Prior to being placed into service, cavity 45 and the lubrication system are precharged with lubricant through the opening covered by plug 53. With the rotation of the bit, centrifugal pressure is developed in the area of O-ring 31 and liquid in this area which initially comprises the lubricant, but which largely becomes mud and water as service time progresses, is forced into cavity 57 through channel 58. A higher fluid pressure is developed in cavity 57 than that in cavity 45 due to the pressure differential developed between centrally located channel 48, which is connected to cavity 45, and channel 58 which is connected to cavity 57; this pressure differential being due to the higher centrifugal pressure developed at the radially outwardly position **58*a* than that at the central location of channel 48, in view of the centrifugal force developed with the rotation of the bit. Thus, in response to this pressure differential, piston 50 operates to force fluid out of cavity 45 through channels 47, 48 and 49** to the roller bit bearings.

Passage 49 feeds the lubricant into cavity 30 where it is cleaned by the centrifugal action before going to the bearing through passage 32, while simultaneously, lubricant is fed directly through passage 48 to the bearing. In this manner, a constant supply of fresh lubricant is provided to the bearing in response to the centrifugal force generated with the rotation of the bit.

Figure 4:
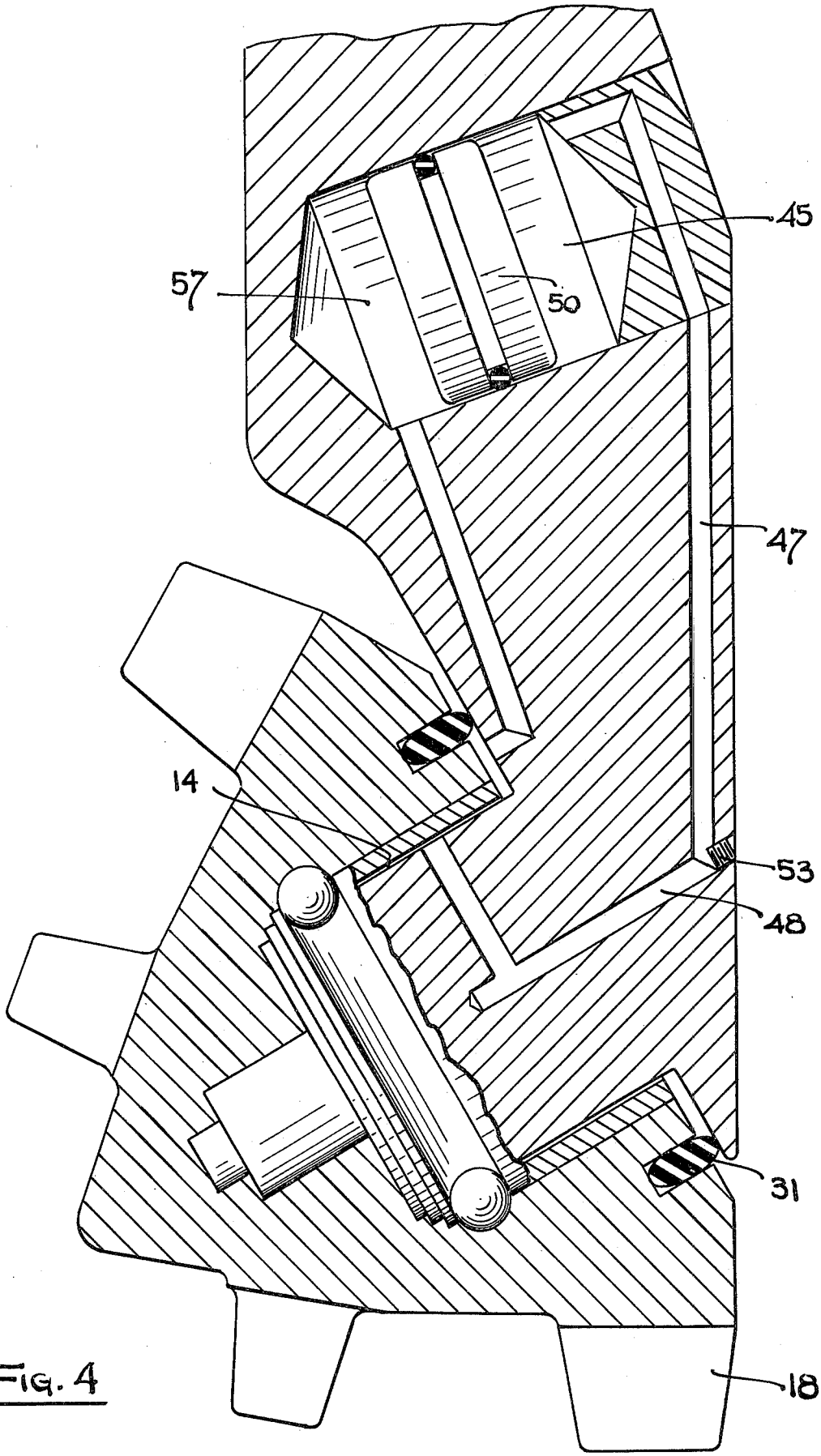
FIG. 4 is a cross-sectional view of a second embodiment of the invention.

Referring now to FIG. 4, a second embodiment of the invention is illustrated. In this second embodiment, the features of the invention of U.S. Pat. No. 4,223,749 are not included, the lubricating system of the present invention being employed without the features of that prior patent. Insofar as the lubricant system of the invention is concerned, this second embodiment is the same as the first except for the elimination of channel 49 which was employed in conjunction with the centrifugal cleaning system of the prior invention. Thus, as in the prior embodiment, lubricant is stored in cavity 45 and forced therefrom by the centrifugal pressure developed in cavity 57 acting on floating piston 50. As for the previous embodiment, the lubricant is forced by such pressure through channels 47 and 48 to the roller cone bearing 14.

While the invention has been described and illustrated in detail, it is to be clearly understood that this is intended by way of illustration and example only and is not to be taken by way of limitation, the spirit and scope of the invention being limited only by the terms of the following claims.

I claim:

1. In a rotary drilling bit mechanism having a shaft and bearing means lubricated by a lubricant for supporting said mechanism for rotation on said shaft, the improvement being means for supplying lubricant to said bearing means in response to the centrifugal force generated with said rotation comprising first cavity means formed in the body of said mechanism for storing the lubricant, first channel means for providing fluid communications between said first cavity means and said bearing means, second cavity means formed in the body of said mechanism, fluid drive means interposed between said first and second cavities for driving lubricant from the first cavity means through channel means to said bearing means in response to a pressure differential between said first and second cavity means, fluid containing means located further radially outwardly from the rotation axis of said drilling bit mechanism than said bearing means such that with rotation of said bit, the centrifugal force generated at said fluid containing means is greater than that generated at said bearing means, and second channel means for providing fluid communication between said second cavity means and said fluid containing means, a pressure differential being developed between said first and second cavities in response to the difference between the centrifugal force generated at said bearing means and said fluid containing means with the rotation of said bit mechanism, thereby causing the fluid drive means to drive lubricant to said bearing means.

2. The drilling bit mechanism of claim 1 wherein the fluid drive means comprises a floating piston slidingly mounted between the first and second cavities.

3. The drilling bit mechanism of claim 1 wherein said drilling bit mechanism includes a centrifugal separator unit positioned radially outwardly of said bearing means, said second channel means including a channel for providing direct fluid communication between the second cavity means and the centrifugal separator unit.

4. The drilling bit mechanism of claim 1 and further including means for filling said first cavity means with fresh lubricant.

5. The drilling bit mechanism of claim 3 wherein said fluid containing means includes the portions of said separator unit radially outwardly from the rotation axis of the bit mechanism.

* * * * *